US005928476A

United States Patent [19]

Daniels

[11] Patent Number: 5,928,476

[45] Date of Patent: Jul. 27, 1999

[54] NONRECOVERY COKE OVEN DOOR

[75] Inventor: Jerry C. Daniels, Abingdon, Va.

[73] Assignee: Sun Coal Company, Knoxville, Tenn.

[21] Appl. No.: 08/914,140

[22] Filed: Aug. 19, 1997

[51] Int. Cl.[6] ..... C01B 27/04; C01B 25/16; C01B 9/00

[52] U.S. Cl. ..... 201/27; 201/15; 201/35; 202/93; 202/102; 202/135; 202/151; 202/248; 202/263

[58] Field of Search ..... 201/15, 27, 35; 202/93, 102, 135, 151, 256, 263, 248

[56] References Cited

U.S. PATENT DOCUMENTS

| | | | |
|---|---|---|---|
| 3,957,591 | 5/1976 | Riecker | 202/263 |
| 4,086,231 | 4/1978 | Ikio | 202/248 |
| 4,100,033 | 7/1978 | Hölter | 201/27 |
| 4,111,757 | 9/1978 | Ciarimboli | 202/93 |
| 4,287,024 | 9/1981 | Thompson | 202/134 |
| 5,114,542 | 5/1992 | Childress et al. | 201/15 |
| 5,228,955 | 7/1993 | Westbrook, III | 202/93 |

*Primary Examiner*—Bekir L. Yildirim
*Attorney, Agent, or Firm*—James L. Bean; Kerkam, Stowell, Kondracki & Clarke, P.C.

[57] ABSTRACT

A coke oven door for closing the open end of an elongated coking chamber of a nonrecovery coke oven, including process air vents extending through the door at a level above a coal charge to be coked, has a structural frame on its outer surface including an elongated manifold extending across the door adjacent its bottom with a plurality of inlet openings in the manifold, and a tubular duct system connecting the manifold to the process air inlets whereby reduced pressure in the oven will draw air through the process air inlets and the duct system to thereby draw emissions from the area at the base of the door into the oven for incineration.

16 Claims, 7 Drawing Sheets

NONRECOVERY COKE OVEN DOOR

BACKGROUND OF THE INVENTION

1. Field of the Invention

This invention relates to emissions control in a nonrecovery coking operation and more particularly to an improved nonrecovery coke oven door having means for capturing and incinerating gaseous and particulate combustion products at the base of the oven door.

2. Description of the Prior Art

The production of metallurgical coke by the nonrecovery process—once all but abandoned in favor of the by product or recovery process—has made a remarkable resurgence with the development of the Jewell-Thompson (Thompson) nonrecovery coke oven. A Thompson oven is disclosed and described in U.S. Pat. No. 5,114,542, reference to which may be had for a more complete understanding of the construction and operation of this type of coke oven. Since such nonrecovery ovens operate at sub-atmospheric (vacuum) pressure, many of the emissions control problems which plague by-product ovens are avoided. For example, the positive pressure within a by-product coke oven presents serious air pollution problems as a result of leakage around oven doors and charging hole covers in the oven roof throughout the coking cycle.

Thompson ovens are charged through an open door by a conveyor which is progressively projected into the oven from a charging and pushing car movable along rails at the pusher side of the battery. At the beginning of the charging operation, the door at the coke side of the oven is closed and a false door having a height equal to the desired depth of coal in the charge is positioned in the lower section of the pusher side door opening. The pusher side door is positioned against the end of the oven immediately above the conveyor to effectively close the door opening and thereby minimize air flow into the oven and the escape of pollutants from the oven during charging. When the oven is fully charged, the conveyor is retracted and the false door is removed to enable the oven door to be lowered and moved into position to close and seal the oven. This charging process and the apparatus used are described, for example, in U.S. Pat. No. 4,287,024.

As is known, coal to be coked in a Thompson oven is finely ground, or crushed, and is to some extent compacted by the weight of the drag type cantilevered charging conveyor so that the oven charge forms a relatively stable mass, or cake, in the hot oven. As the charging conveyor approaches the end of its travel through the oven, the ground coal flows into contact with and is compacted against the closed door on the coke side of the oven.

The hot refractory structure of the oven floor and walls ignites the coal on contact during charging, and some coal burning occurs. Since the oven is effectively closed during charging by the false door, the conveyor and the pusher side door, draft from the stack effectively prevents escape of emissions from this limited burning, and immediately upon closing the oven, a vacuum is applied throughout the oven chamber above the coal charge. While this vacuum is effective in withdrawing distillation products and emissions from the chamber above the coal charge and with the oven floor system as described in the above-mentioned U.S. Pat. No. 5,114,542, the depth of the charge and the dense or compact nature of the charge initially offers resistance to the upward flow of smoke and emissions from burning coal at the floor of the oven. As a result, a slight positive pressure can develop at or adjacent to the oven floor at the start of a coking cycle. This positive pressure can result in emissions from the bottom of the charge in the area adjacent to the oven doors escaping beneath the door, particularly the coke side door where the coal is more firmly packed against the door. As oxygen depletion from the air in the coal charge effectively slows and stops burning at the bottom of the charge, and gas escape channels are formed through the charge to the vacuum in the crown of the oven, the positive pressure is eliminated and the escape of emissions beneath the door ceases.

In order to limit the escape of emissions from beneath the bottom of the oven doors at the start of a coking cycle, it has been the practice to manually place a strip of a ceramic fiber insulating blanket in position overlapping the base of the door and the threshold when the doors are installed. This relatively dense blanket partially blocks any opening at the bottom of the door and filters particulates from any escaping combustion products. This practice has not been entirely satisfactory however not only because the blanket is incapable of completely blocking the escape of emissions, but also because it has to be manually placed against each door at the beginning of each cycle and manually removed prior to opening the door for pushing the oven. Further, the ceramic fiber blanket material is relatively expensive and is subject to damage so that it has to be replaced frequently. It is, therefore, an object of the present invention to provide an improved nonrecovery coke oven door which substantially eliminates the escape of pollutants from the vicinity of the oven door base.

The improved coke oven door of this invention includes means for applying a draft along the full width of the door at its base to draw pollutants from this area into a sealed passageway or duct system within the door frame or support structure and leading to the air inlet of the oven above the coal charge in that oven. Adjustable damper means preferably is provided in the duct system to control the draft applied at the base of the door. The door frame duct system is connected to the air inlet downstream of the process air regulating valves whereby the vacuum in the oven chamber can be regulated to draw a portion of the process air into the chamber through the duct system in the door to thereby substantially eliminate all emissions generated in the vicinity of the base of the door. The process air dampers may be closed, or partially closed, at the beginning of a coking cycle to assure an adequate draft applied along the base of the door. Shortly after the start of a cycle when the escape of emissions is no longer a problem, the process air dampers may be opened and the door duct system damper means closed for the remainder of the coking cycle.

SUMMARY OF THE INVENTION

The foregoing objects and advantages of the invention are achieved in a door dimensioned to fit closely within and close the oven door opening, with the door including a rigid structural steel frame supporting a steel door plate on its inner surface and a cast or poured refractory slab covering the inner surface of the door plate. At least one process air inlet extends through the oven door, at a level above the top of any coal charge to be coked in the oven, with each air inlet preferably including a butterfly type damper valve which may be adjusted to control the flow of process air into the oven chamber. Each air inlet typically includes a length of metal pipe rigidly welded to the door plate and projecting outwardly therefrom with a damper valve in its outwardly projecting open end portion.

In accordance with the present invention, the structural steel frame portion of the door is made up, at least in part, of elongated hollow tubular members, or other steel shapes welded to the door plate to effectively form tubular members. One such tubular member extends along the full width of the door at its bottom edge portion, with the opposite ends of this bottom or base tubular member preferably being closed to the atmosphere. The tubular structural members preferably are of generally rectangular cross section, and the downwardly directed surface of the base tubular member has a plurality of openings extending therethrough at spaced intervals along its length.

At least one upwardly extending tubular frame member has its bottom end opening into and in fluid communication with the interior of the base tubular member, and its upper end connected either directly or through one or more further tubular members to at least one outwardly projecting process air vent pipe to provide a fluid flow path through the door frame structure from the base frame member into the coking chamber. Thus, the vacuum within the oven which draws process air through the process air vent will also provide a draft to the tubular frame structure from the connected vent pipe, or pipes, to the base frame member whereby air and escaping emissions, including particulates, from burning coal in the vicinity of the base of the door will be drawn through the plurality of openings into the base tubular frame member and from there through the door frame structure and the oven air inlet into the oven chamber to be consumed. Preferably a steel plate member forms a skirt or baffle extending downwardly from the outwardly directed surface of the base tubular member to provide an effective screen or trap for emissions from burning coal escaping beneath the door at the beginning of a cooling cycle to assure that such emissions are drawn into and through the door frame structure to be incinerated in the oven chamber and flue system.

BRIEF DESCRIPTION OF THE DRAWINGS

Other features and advantages of the improved coke oven door according to the present invention will be apparent from the following detailed description, taken in conjunction with the drawings, in which.

DESCRIPTION OF THE PREFERRED EMBODIMENT

Figure 1:
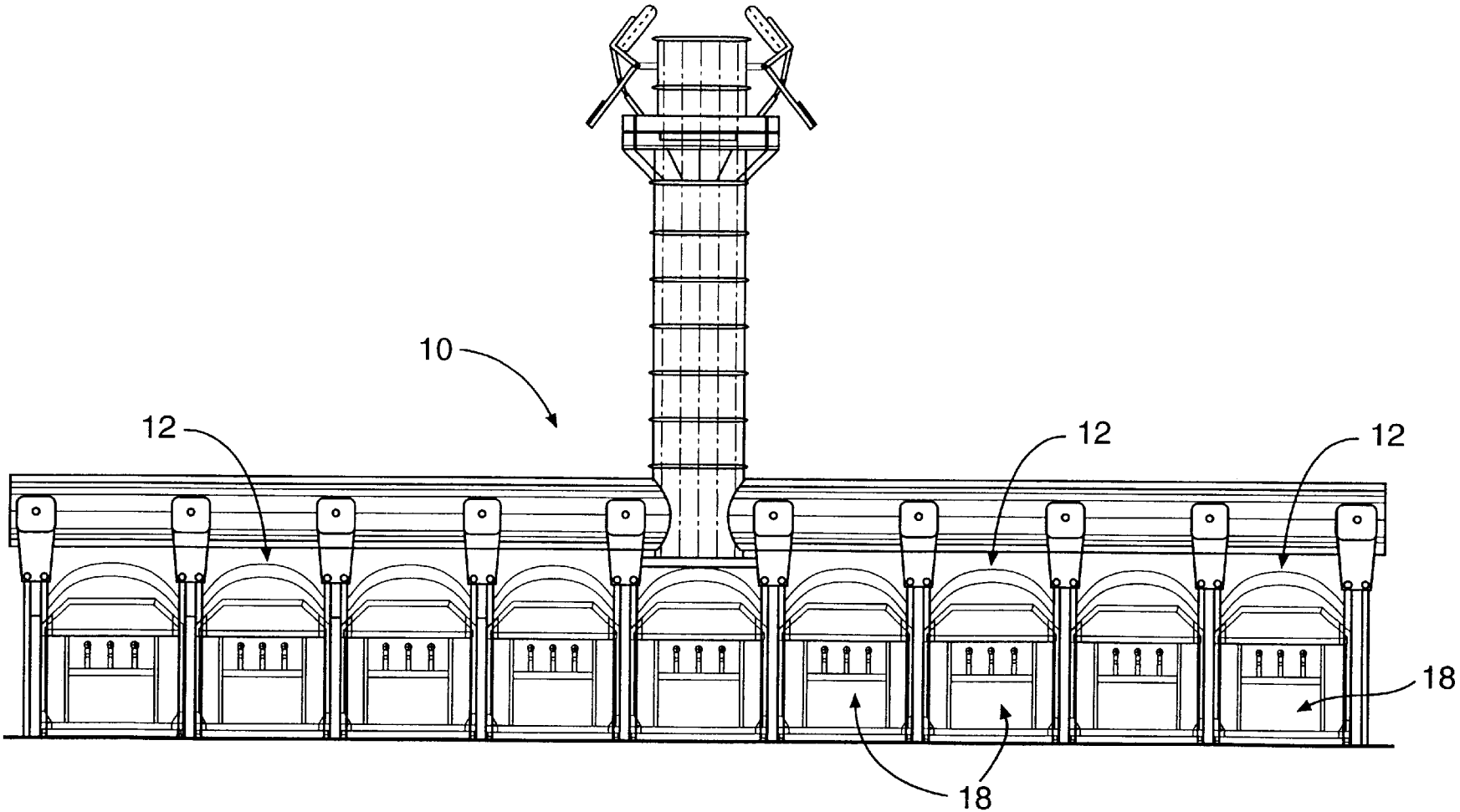
FIG. 1 is an elevation view schematically showing the coke side of a Thompson coke oven battery employing the improved oven door according to the present invention.
Figure 2:
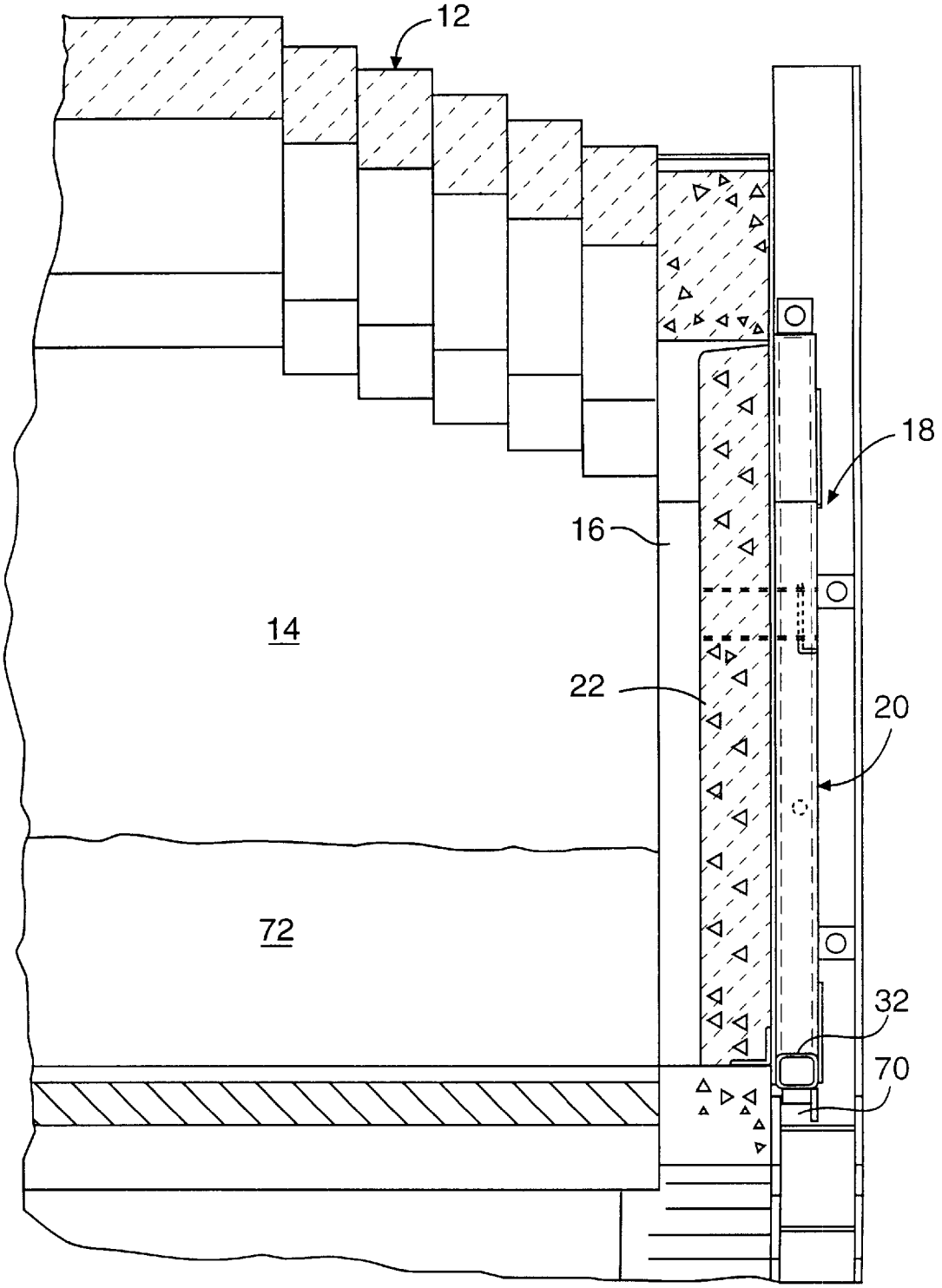
FIG. 2 is an enlarged fragmentary sectional view of one end portion of an oven having the improved door installed therein.

Referring now to the drawings in detail, FIG. 1 schematically illustrates a battery 10 of Thompson nonrecovery coke ovens. The battery 10 includes a plurality of individual ovens 12 constructed in side-by-side relation with adjacent ovens having common sidewalls. As described in the above-mentioned U.S. Pat. No. 5,114,542, a system of sole flues extending beneath each oven is connected to the oven crown by downcomers in the sidewalls and to a common waste heat tunnel and stack by uptakes in the sidewalls. Each oven 12 has an elongated open ended coking chamber 14 (FIG. 2), with each open end 16 being closed by a removable door 18 during the coking operation. The doors at each end of the ovens may be identical and therefore only the door opening 16 and door 18 on the coke side of the battery is shown in the drawings and described herein below. Since more pollutants are normally produced by burning coal at the coke side door, the improved door may, if desired, be used only on the coke side door openings.

Figure 3:
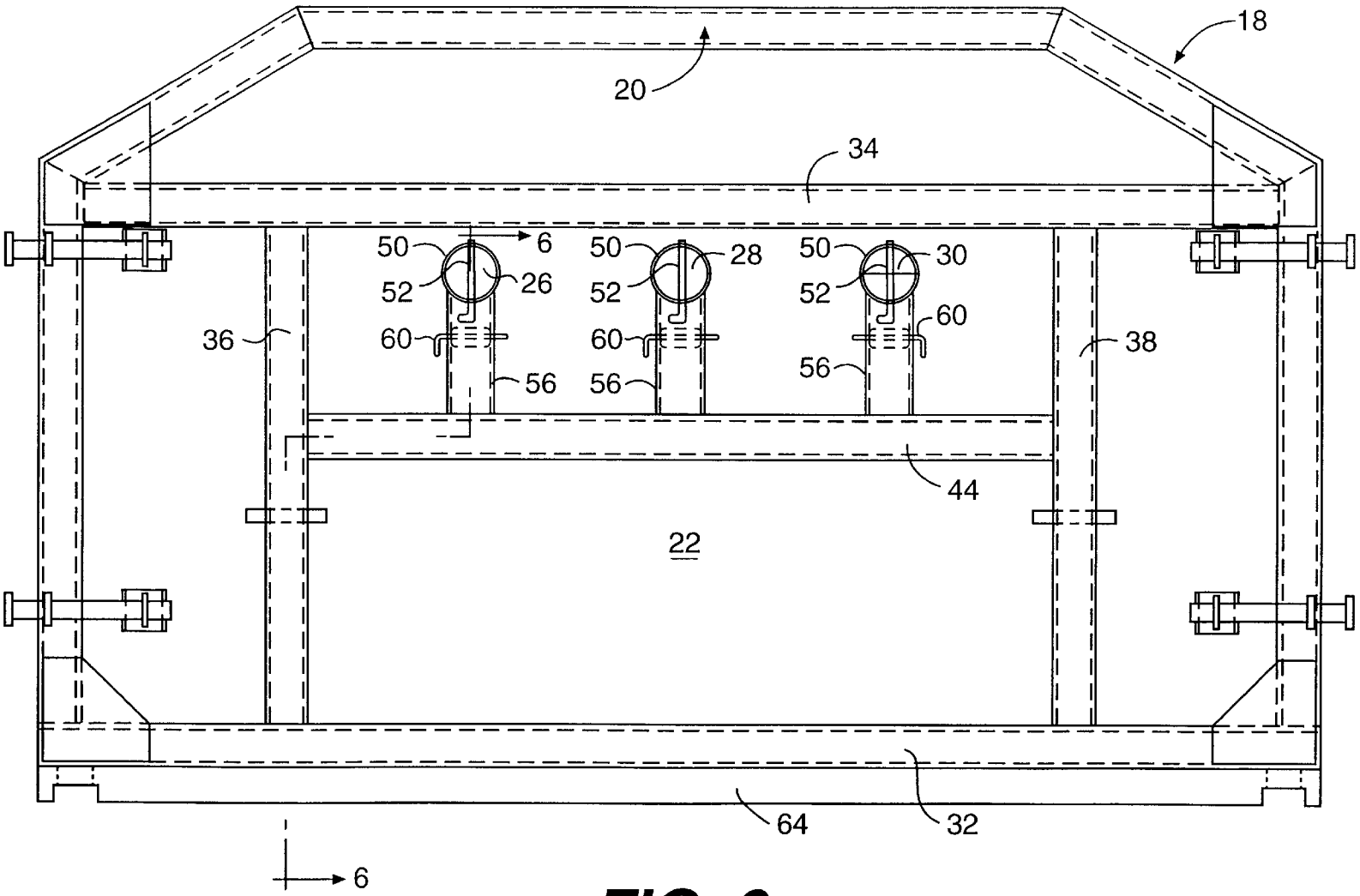
FIG. 3 is an elevation view of a coke oven door embodying the invention.
Figure 4:
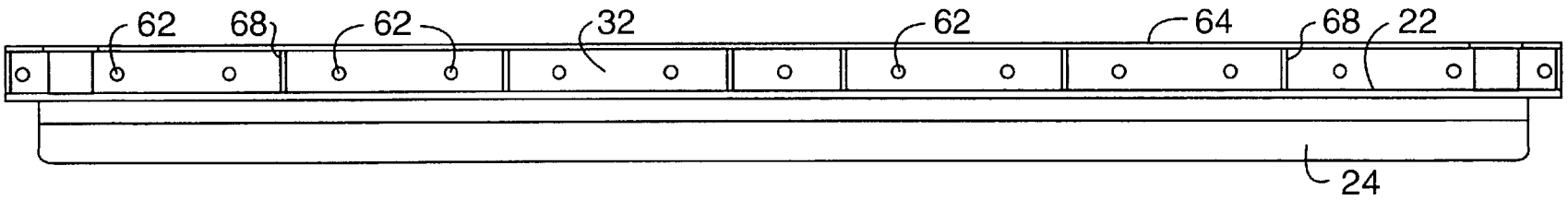
FIG. 4 is a bottom plan view of the coke oven door shown in FIG. 3.
Figure 5:
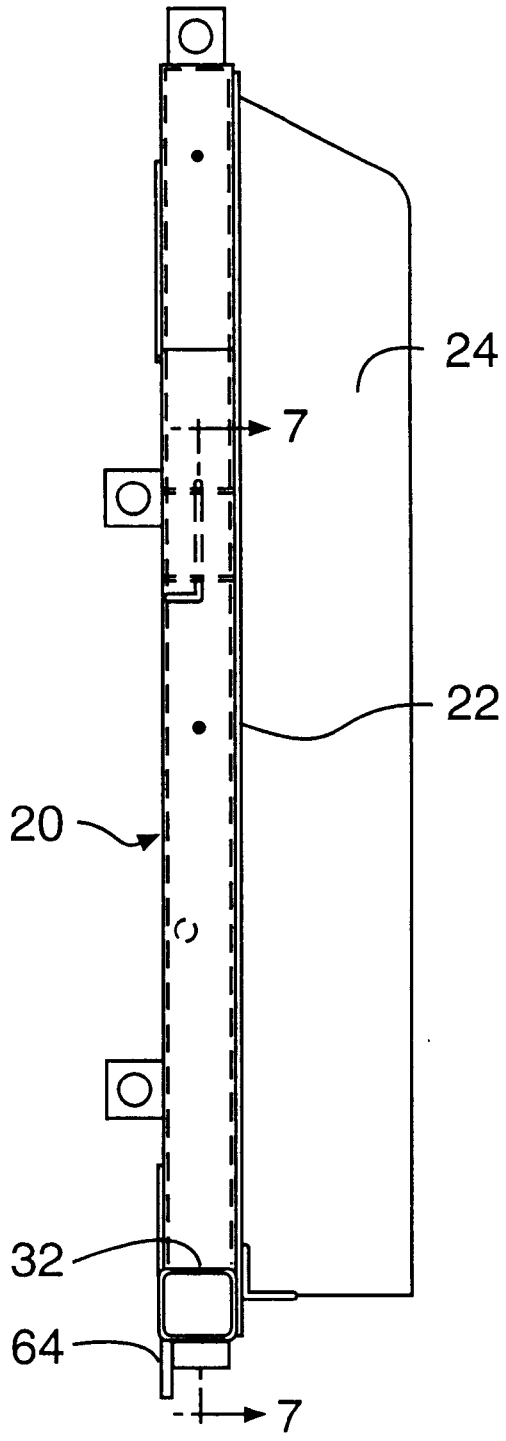
FIG. 5 is a side elevation view of the door.
Figure 6:
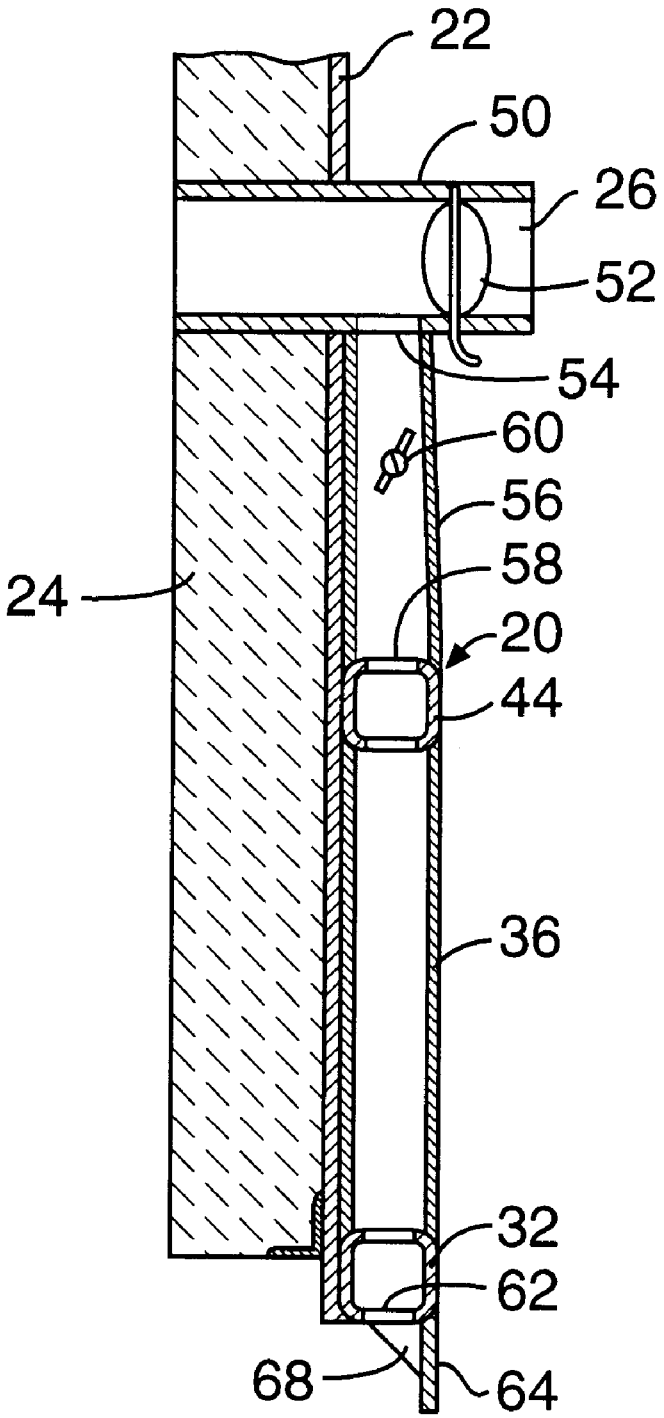
FIG. 6 is a fragmentary sectional view taken along lines 6—6 of FIG. 3.

Referring to FIGS. 3–5, it is seen that the door 18 comprises a plurality of elongated steel structural members welded together to form a rigid unitary structural frame or support assembly indicated generally at 20. The structural members of frame 20 are preferably steel tubular members of generally rectangular cross section, but may be of other configurations such as a standard rolled steel channel or a built-up welded structure as more fully explained herein below. The support assembly 20 includes an outer peripheral frame having a size and shape generally corresponding to the size and shape of the open end 16 of the coke chambers 14, and a heavy steel plate 22 is rigidly welded to and covers the inwardly directed surface of the support assembly 20. A poured or cast refractory block 24, dimensioned to fit closely within the door opening 16 is supported upon the inwardly directed surface of steel plate 22. The steel plate and refractory slab or block form an effective heat insulated door closure for the oven. A plurality of process air vents 26, 28, 30 are formed inland extend through plate 22 and slab 24 to provide a controlled flow of air into the oven.

The peripheral frame portion of the support structure comprises a plurality of elongated, generally rectangular steel tubular members having their adjacent ends rigidly welded together and includes a base member 32 or collecting manifold extending the full width of the door adjacent its bottom edge. A second horizontal member 34 extends parallel to base 32 at a location above the process air vents 26, 28, 30, and a pair of vertical tubular steel members 36, 38 extend between base 32 and horizontal member 34, one spaced inwardly from each side edge of the door. Vertical members 36, 38 have their bottom ends in fluid communication with base 32 through openings in the upwardly surface base 32. An intermediate horizontal steel tubular member 44 extends between the vertical members 36, 38 at a location above base member 32 and below the vents 26, 28, 30, and has its ends in fluid communication with the interior of the respective vertical members 36, 38.

Figure 7:
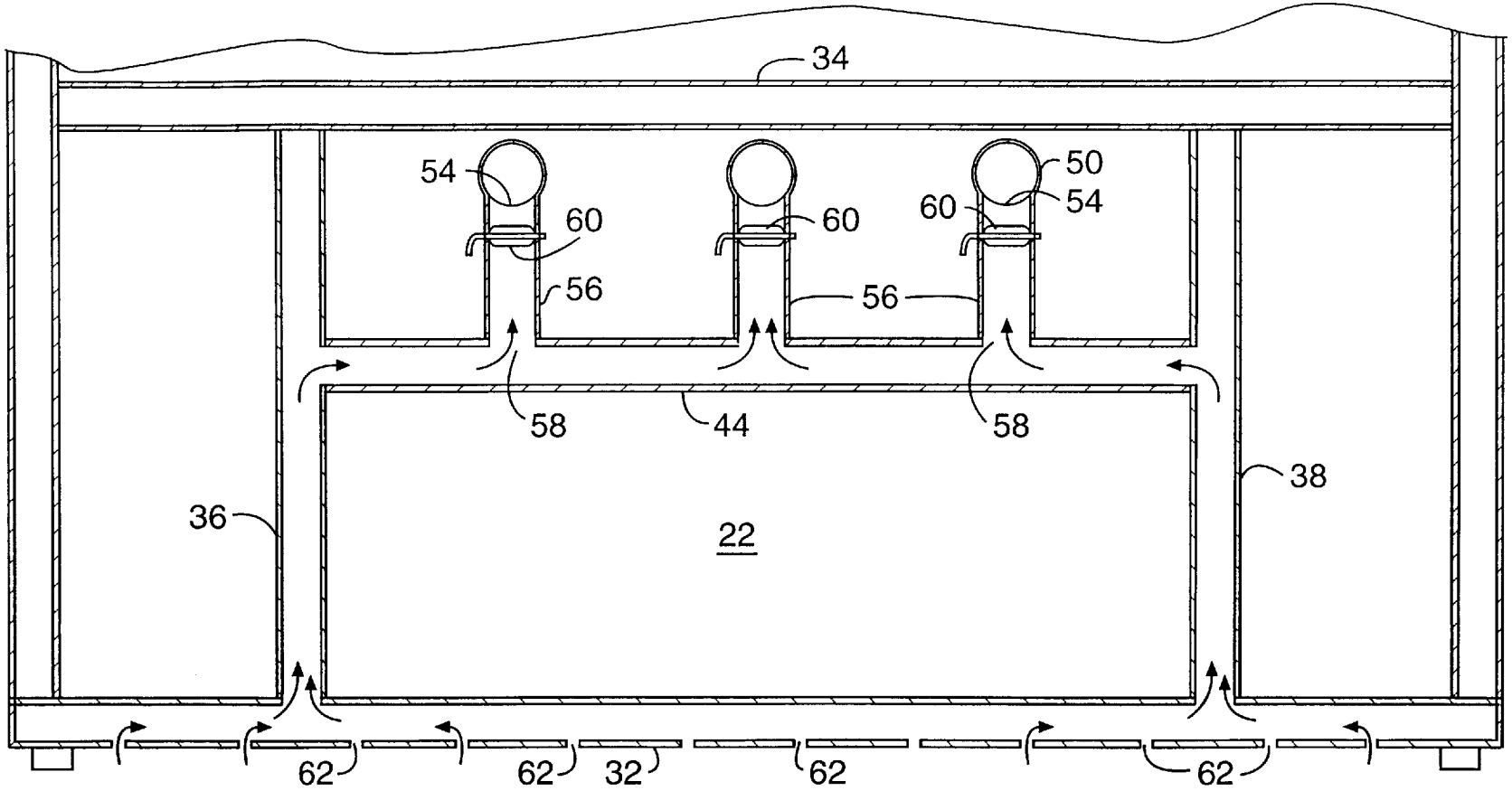
FIG. 7 is a fragmentary sectional view taken along lines 7—7 of FIG. 5.

Vents 26, 28, and 30 are substantially identical and each includes a short length of pipe 50 rigidly welded to and projecting inwardly through refractory slab 24 and outwardly from the surface of plate 22. A manually operable butterfly or damper valve 52 is mounted in each vent pipe 50 adjacent the outwardly projecting open end thereof. An opening 54 (see FIG. 7) is formed in the lower portion of each vent pipe 50 at a location inboard of the valves 52, and a connecting tube 56 has its open top end rigidly welded to the pipe 50 to provide fluid communication through the opening 54. The lower end of tube 56 is welded to the horizontal tubular member 44 and is in fluid communication therewith through opening 58. A manually operable damper valve 60 is mounted in each tube 56 to control the flow of air therethrough.

As best seen in FIG. 4, a plurality of vent openings 62 are formed in the downwardly directed or bottom surface of base frame member 32 at spaced intervals along substantially its full length to effectively form an emissions collecting manifold, and a baffle plate or shield 64 is welded to and extends downwardly from the outer surface of base member 32. A plurality of gussets 68 are welded between the shield 64 and the bottom surface of base frame 32 to provide a rigid shield structure capable of withstanding substantial loads in handling of the door. The baffle cooperates with the manifold and adjacent oven structure to provide a temporary trap for escaping emissions to assure that the emissions are drawn into the manifold.

The outwardly directed surface of the oven door threshold or sill cooperates with the shield 64 and the bottom surface of the base frame member 32 to form a trap or chamber 70 along the bottom of the door in the area of any emissions escaping from beneath the door. Such emissions are trapped for a time sufficient to be drawn through the openings 62 by the draft through the tubular frame members of the door structure and the process air vents into the interior of the oven. The extent of draft through the door frame structure can be regulated by adjusting the position of the damper valves 52 in the tube members 50 and the damper valves 60 in vent pipes 56. Thus, gaseous and particulate products of combustion, which previously either escaped into the atmosphere or were partially trapped and filtered by the ceramic fiber insulating blanket, are effectively trapped and completely consumed within the oven and sole flue system. If desired, after such the escape of emissions ceases the damper valves 60 may be closed and the door will operate in the conventional manner. An effective emissions control is thus accomplished in accordance with the invention without requiring substantial modification to the conventional door structure and without affecting the structural integrity of the door.

Although the refractory block 24 and its rigid support structure normally sit directly on the sill portion of the door opening, no attempt is made to insure a completely gas-tight seal in this area. Also, repeated handling of the door inherently results in damage to the bottom surface of the refractory block so that only a very slight positive pressure in the area beneath the coal charge 72 at the base of the door can produce some minor leakage for a short period at the beginning of the coking cycle. The improved door structure provides an effective and economical means of capturing and incinerating any such emissions which occur.

While the welded frame support structure of the door is illustrated and described as being made up of generally rectangular tubular steel members, it is believed apparent that other structural elements may be employed to define portions of the door support structure and that the closed gas flow path from the base member 30 to the door vents may be defined by different structures which will provide the closed conduit system. For example, instead of structural steel tubes, a rolled structural channel or other standard steel shape may be welded directly to the plate 22 to provide conduit means defining the closed flow path, or a plurality of plate members may be welded together to define the conduit means. Further, various frame member configurations may be employed, including the additional of a vertical member extending for example from the central portion of base member 30 directly to a horizontal member such as member 52 providing, in effect, a collecting manifold and conduit for the entrance to the process air vents. Also, separate upwardly extending tubular members may be connected directly between member 32 and each vent pipe 50. Thus, it is believed apparent that various modifications may be made to the invention and it should be understood that the invention is not limited to the embodiment disclosed, but rather that it is intended to include all embodiments thereof which would be apparent to one skilled in the art and which come within the spirit and scope of the invention.

What is claimed is:

1. An improved coke oven door for use in a nonrecovery coke oven having an elongated coking chamber for receiving a charge of coal to be coked therein and a door opening at each end closed by a removable oven door, said oven door comprising, a generally flat metal door plate having inner and outer surfaces and a bottom edge, the door plate being dimensioned to extend over and cover a door opening at one end of the coking chamber with said bottom edge extending adjacent the bottom of the door opening, a refractory block mounted on the inner surface of the door plate, the refractory block being dimensioned to project into and closely fit within the door opening, an elongated emissions collecting manifold mounted adjacent to said bottom edge of said door plate at its outer surface and extending across substantially the full width thereof, said collecting manifold having a downwardly directed surface and a plurality of emissions inlet openings in said downwardly directed surface, and elongated conduit means having one end in fluid communication with said collecting manifold and its other end in fluid communication with the interior of the coking chamber through said door plate and said refractory block whereby vacuum within the coking chamber during operation of the oven will apply a draft to said collecting manifold to draw emissions into said collecting manifold through said plurality of openings and from said collecting manifold through said conduit means into the oven chamber.

2. The door defined in claim 1 further comprising draft control valve means connected in said elongated conduit means for regulating the draft applied to said collecting manifold.

3. The door defined in claim 2 further comprising structural frame means rigidly mounted on said outer surface, said collecting manifold and said conduit means defining a part of said structural frame means.

4. The door defined in claim 3 further comprising an elongated baffle mounted on said door and extending below said manifold to provide a temporary trap for emissions escaping beneath the door whereby substantially all such emissions are drawn into the manifold.

5. The door defined in claim 1 wherein said door further comprises process air vent means extending through said door plate and said refractory block for admitting process air into the coking chamber, said process air vent means including a length of conduit having an open end spaced outward from said outer surface and wherein said conduit means has its other end connected in fluid communication with said process air vent means at a location between said open end and said outer surface.

6. The door defined in claim 5 wherein said process air vent means includes first damper valve means operable to regulate the flow of air through said inlet into the coking chamber.

7. The door defined in claim 6 wherein said conduit means is connected in fluid communication with said process air vent means at a location between said first damper valve means and said door plate.

8. The door defined in claim 7 further comprising second damper valve means connected in said conduit means.

9. The door defined in claim 8, further comprising structural frame means rigidly mounted on said outer surface, said collecting manifold and said conduit means defining a part of said structural frame means.

10. The door defined in claim 9 wherein said process air vent means comprises a plurality of vent pipes extending through said door plate and having an open projecting outwardly thereupon, each said vent pipe having damper valve means connected therein.

11. The door defined in claim 10 wherein said conduit means comprises a plurality of tubular members having an end connected in fluid communication one to each of said vent pipes and its other end connected in fluid communication with said manifold means.

12. The door defined in claim 10 further comprising an elongated baffle mounted as said door and extending below said manifold to provide a temporary trap for emissions escaping beneath the door whereby substantially all such emissions are drawn into the manifold.

13. A method of controlling emissions escaping beneath the oven door of a nonrecovery coke oven at the beginning of a coking cycle comprising providing an elongated emissions collecting manifold adjacent to the bottom of the door and extending substantially across the full width of the door, said manifold being in the form of an elongated tubular member having emissions inlet opening means along its length, applying a draft to the manifold by connecting the interior of the manifold to the sub-atmospheric pressure existing in the nonrecovery coke chamber through an elongated conduit system having one end connected in fluid communication with the manifold and its other end in fluid communication with the interior of the coke oven, and providing a draft regulating valve in the elongated conduit system, whereby emissions escaping beneath the door are drawn into the manifold and through the conduit system into the oven by the existing sub-atmospheric pressure within the oven.

14. The method defined in claim 13 further comprising providing a baffle extending along the length of and cooperating with the manifold to provide a temporary trap for escaping emissions to thereby assure that substantially all escaping emissions are drawn into the manifold.

15. The method defined in claim 14 wherein said oven door includes at least one process air vent having a draft control valve connected therein, and wherein the elongated conduit is connected to said at least one process air vent between the draft control valve and the interior of the oven.

16. The method defined in claim 15 further comprising the step of providing a draft control valve in the elongated conduit system for regulating the draft applied to the manifold.

* * * * *